United States Patent [19]

Logsdon

[11] Patent Number: 4,961,848

[45] Date of Patent: Oct. 9, 1990

[54] DRAIN GRATE WITH PRIMARY AND SECONDARY WEIRS

[75] Inventor: Duane D. Logsdon, Fullerton, Calif.

[73] Assignee: Logsdon Foundation, Stanton, Calif.

[21] Appl. No.: 352,957

[22] Filed: May 17, 1989

[51] Int. Cl.[5] ..... E03F 5/14

[52] U.S. Cl. ..... 210/165; 210/166; 405/127

[58] Field of Search ..... 210/163, 164, 165, 166; 405/127

[56] References Cited

U.S. PATENT DOCUMENTS

| | | | |
|---|---|---|---|
| 1,266,948 | 5/1918 | Holt | 210/166 |
| 2,256,626 | 9/1941 | Rile | 210/166 |
| 2,284,416 | 5/1942 | Gordon | 210/166 |
| 2,666,493 | 1/1954 | Gordon | 210/166 |
| 3,529,723 | 9/1970 | Hagedorn | 210/163 |
| 4,652,365 | 3/1987 | Ebeling | 210/163 |

FOREIGN PATENT DOCUMENTS

| | | | |
|---|---|---|---|
| 722015 | 11/1965 | Canada | 210/163 |

*Primary Examiner*—Frank Spear
*Assistant Examiner*—Joseph Drodge
*Attorney, Agent, or Firm*—Price, Gess & Ubell

[57] ABSTRACT

An improved roof drain cover useful in minimizing the changes of comparatively large amounts of water backing up around the drain can be constructed so as to include primary and secondary rims serving as weirs located on a flange which extends around a centrally positioned grate. The primary rim is formed at the periphery of the flange and integrally therewith, while the secondary rim is formed adjacent the junction of the flange and grate and forms a channel with the grate. Notches are provided in these rims so as to permit water flow through them. The dimensioned rims are so that, as such inorganic particles accumulate against them, lighter organic material such as leaves will be carried by draining water over the rims and up against the grate.

5 Claims, 2 Drawing Sheets

DRAIN GRATE WITH PRIMARY AND SECONDARY WEIRS

BACKGROUND OF THE INVENTION

The invention set forth in this specification pertains to new and improved perforate roof drain covers for use on flat or essentially flat roofs which are covered with comparatively small particles of gravel of other inorganic materials.

Flat or nearly flat roofs commonly used are frequently covered with comparatively small inorganic particles so as to protect the organic materials in the roof from deterioration cause by actinic light and, in some cases, for other reasons. Although on occassion such particles may to at least a degree be bonded in place they are usually merely scattered on a roof so as to be held in place by gravity. Although this is usually satisfactory since the weight the particles keeps them in place, at times, it is not satisfactory because, during heavy rains or the like, the flow of water on a roof will tend to move such particles toward and into the drain or drains used to prevent water from accumulating on a roof to such an extent that there is a possibility of structural or other damage.

Although such drains can be constructed in many different ways, they are frequently constructed so as to use a centrally located pipe of pipe section extending downwardly from a funnel like transition area having an outwardly extending flange located at its open end. The transition area is normally covered by a screen or related perforate member designed to preclude the entrance of any material other than water into the pipe or pipe section. These screens or related members can be and are commonly referred to as "grates". They can be constructed in many different ways. Such grates are normally designed to act as perforate barricades, which will hold back any debris from passage through the drain.

Such drains are normally installed so that the flange lays in a recess in the roof so as to support the drain and so that the pipe section is connected to an appropriate sewer line. Normally the flange is covered with or bonded to the material in a roof so that any water on the roof will not get under the flange but instead will flow through the drain. Drains or drain structure of this category are shown in the Logsdon U.S. Pat. Nos. 3,884,809 entitled Scupper Drain Structure and 4,487,690 entitled Sump Or Flush Installable Roof Drain. Several known screen type perforate members are indicated in the Logsdon U.S. Pat. Nos. 4,400,272 entitled Drain Grate With Adjustable Weirs and 4,525,273 which is also entitled Drain Grate With Adjustable Weirs.

Because of the manner in which such drains are constructed, all sorts of debris can easily accumulate within them. As this occurs they are apt to become either completely or partially stopped up. This is undesirable because of the possibility of roof damage. Both organic items such as leaves and scrap paper and various inorganic particles will normally tend to accumulate, causing drains on gravel or similarly covered flat or nearly flat roofs to stop up. However, in studying the tendency of such drains to stop up it has been noticed that such organic and inorganic materials tend to "act" differently in causing a drain stoppage.

Because such inorganic particles usually or normally are somewhat heavier than leaves and related organic materials, they tend to move generally along the surface of a roof and to accumulate in the general region around the base of the perforate member or grate while the organic materials tend to "float" over these inorganic particles so as to accumulate on top of them against the grate. As a result of this, there will be a tendency for the particles to form a somewhat perforate ring around base of the perforate member or grate.

This grate will then tend to act more or less like a leaky dam so as to cause leaves and the like to float higher and higher. Concurrently organic materials will pile up on or accumulate within this ring against the grate so as to decrease its permeability. All of this will have the effect of making it more difficult for water to drain from a roof. As a result, there will be a tendency for the water to accumulate on the roof more or less as water tends to accumulate in back of a dam before flowing over the dam. As this occurs, the danger of damage resulting from the weight of the water accumulation increases.

It will be realized that this is something of any oversimplification of what actually occurs at and adjacent to a roof drain during a heavy rain when loose inorganic particles and leaves, paper and other related materials are present. However, it effectively indicates that there is a need for improved roof drain covers—more specifically-roof drain coversm which are designed and constructed so as to minimize the chances of accumulations adjacent to or against a roof drain screen or grate causing a siginificant body of water from accumulating on a roof.

BRIEF SUMMARY OF THE INVENTION

A broad objective of this invention is provide a new and improved roof drain cover. More specifically it is an objective of this invention to provide roof drain covers which fulfill the need indicated in the preceding discussion. From this it will be apparent that the invention is intended to provide roof drain covers which are constructed so as to minimize the chances of both inorganic particles and organic materials such as leaves, paper and the like from cooperating to form what may be loosely referred to as a "dam" around a perforate cover over the entrance to a drain pipe of drain pipe section in a roof drain which might cause significant accumulation of water on a roof.

It is not to be assumed that the roof drain covers of the invention will prevent any an all accumulations which will impede water from flowing into a roof drain. They will not do this. They are intended to prevent or hold back the formation of accumulations which will significantly impede water from flowing into a roof drain. Since the presence of virtually anything in the vicinity of a roof drain cover will, to a degree, delay water flow and since materials will accumulate on the roof drain covers of the invention they cannot be expected to eliminate any and all tendency for material on a roof to delay or hold back water flowing into a roof drain.

According to the present invention, the preceding objectives are achieved by providing a roof drain cover having a centrally located, upstanding, perforate, hollow grate and a peripherial mounting flange attached to the periphery of the bottom of said grate so as to extend outwardly therefrom in which the improvement comprises: a primary upstanding rim serving as a weir attached to the periphery of said flange so as to extend upwardly from said flange a distance less than the height of said grate, said primary rim having a plurality of notches located so as to extend from the upper end of said rim toward the flange, said notches in said primary rim being equally spaced from one another and terminating above said flange, a secondary upstanding flange also serving as a weir attached to said flange adjacent to the base of said grate so as to be spaced from said base of said grate and so as to extend upwardly from said flange a distance less than the height of said grate, said secondary rim having a plurality of notches located so as to extend from the upper end of said rim toward the flange, said notches in said secondary rim being equally spaced from one another and terminating above said flange, and particle collection means located in said flange between said rims.

BRIEF DESCRIPTION OF THE DRAWINGS

The importance of the structure described in the preceding paragraph and an understanding of the invention will be expedited by a consideration of the remainder of this specification in connection with the accompanying drawings in which.

Figure 1:
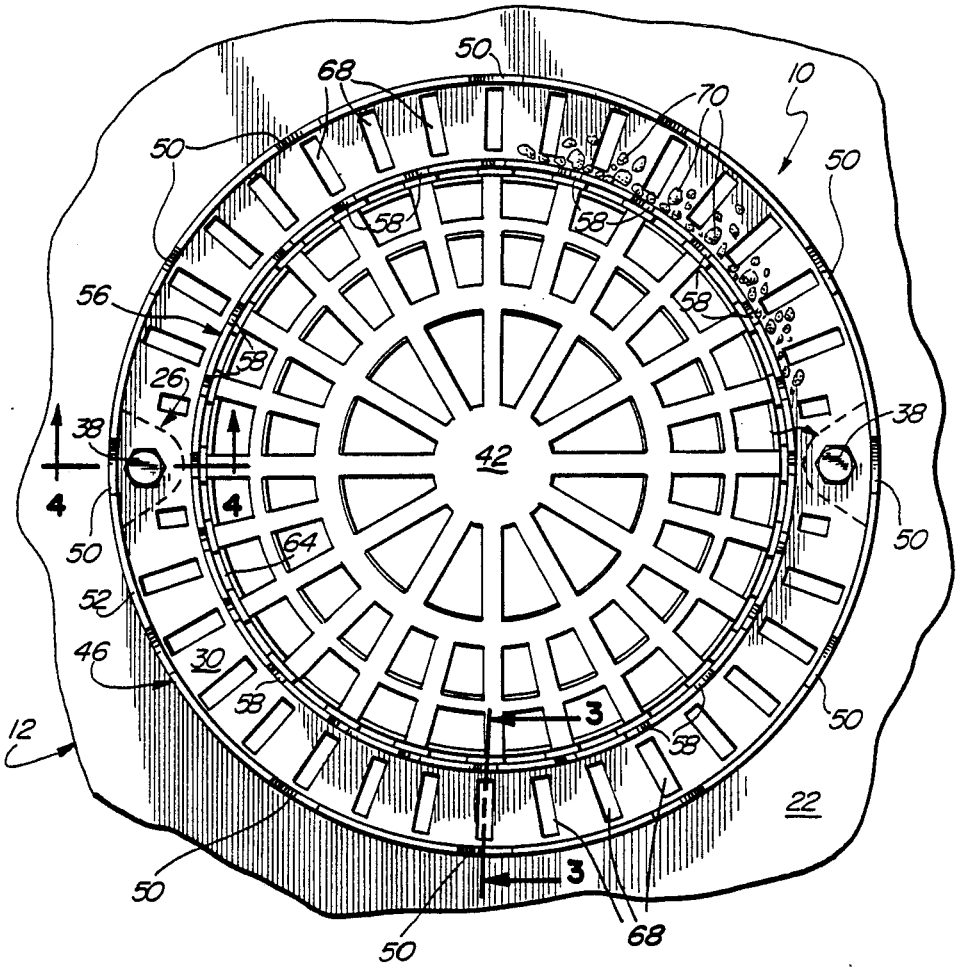
FIG. 1 is a top plan view of a presently preferred embodiment of an improved perforate roof drain cover in accordance with this invention as installed on a portion of a roof.
Figure 2:
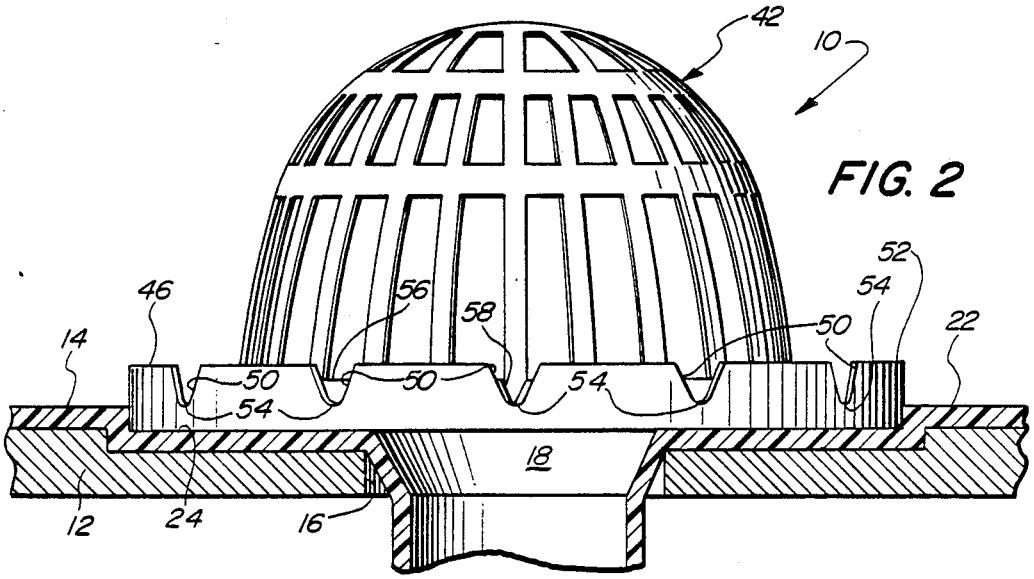
FIG. 2 is a side elevational view of the roof drain cover shown in FIG. 1 in which the roof is broken away so that entire drain cover is viewed in elevation.
Figure 3:
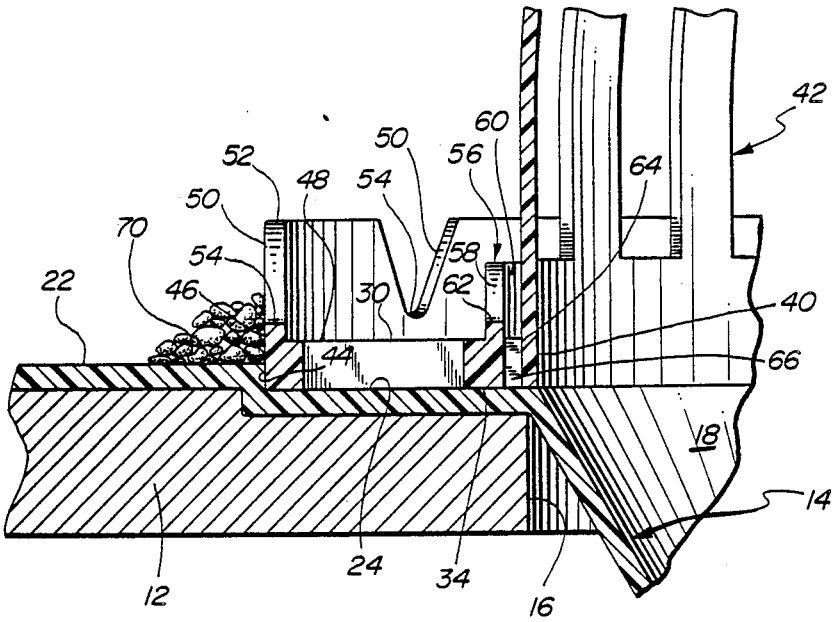
FIG. 3 is a partial cross-sectional view at an enlarged scale taken at line 3—3 of FIG. 1.
Figure 4:
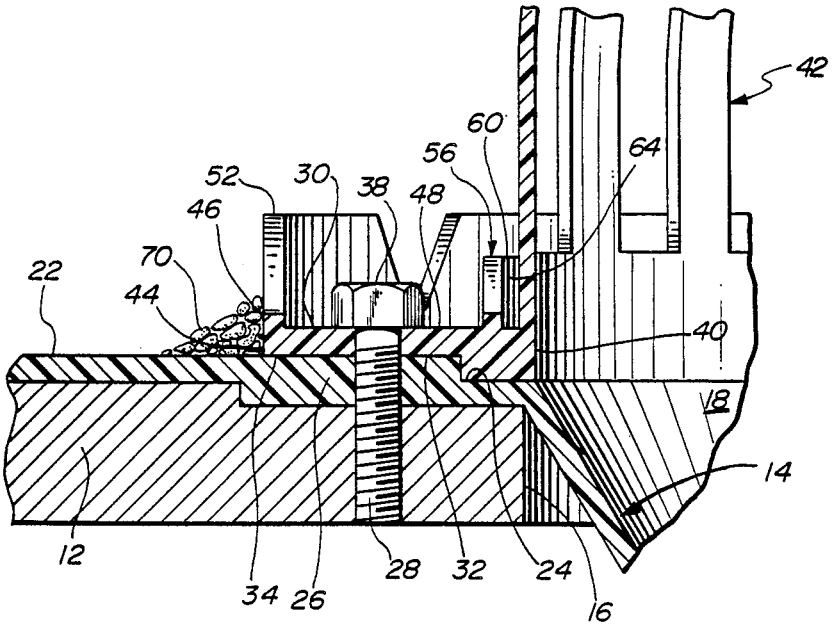
FIG. 4 is another partial cross-sectional view at an enlarged scale taken at line 404 of FIG. 1.

The perforate roof drain cover illustrated in the drawing is constructed so as to use the concepts or principles of the invention set forth in the appended claims. It will be recognized that these concepts or principles can be embodied in various roof drains covers which are either constructed differently or which look differently than the roof drain cover illustrated and subsequently described herein through the use of routine skill in the field of the design of plastic plumbing items. Because of this, the invention is not to be considered as being limited to precisely the roof drain structure illustrated and described.

DETAILED DESCRIPTION OF THE PREFERRED EMBODIMENT

In the drawings there is shown an improved roof drain cover 10 in accordance with the present invention which is preferably formed as a unitary article out of a polymer composition or "plastic" as is commonly used currently in the manufacture of known roof drains and similar structures. This cover 10 is constructed so that it can be conveniently used on a conventional roof 12 in conjunction with a known roof drain 14. This roof drain 14 is also preferably formed as a unitary body out of a polymer composition as indicated in the preceding. Because of the conventional character of both the roof 12 and the drain 14, neither of them is described in detail in this specification and they are only described herein to the minimum extent deemed necessary to satisfactorily explain the present invention.

The drain 14 is used in conjunction with a hole 16 in the roof 12 so that a tapered, funnel like transition section 18 of it extends through the hole 16 in connecting a lower pipe of pipe section 20 to a top, generally flat flange 22. This flange 22 rests on the roof 12 so as to support the drain 14 and is normally bonded to the roof 12 in a conventional manner so that there is no danger of leakage under it to the hole 16. This flange 22 is preferably provided with a flat, disk like depression 24 extending concentrically around the section 18. Small, identical, diametrically opposed locating flat areas 26 are preferably provided within the depression 24. Normally conventional bolts 38 or similar fasteners will be carried by the flange 24 so as to extend upwardly from within these areas 26.

The dimensions of the drain 14 are normally coordinated with those of the drain cover 10 so that a flat, circular peripheral mounting flange 30 on the cover 10 fits closely within the depression 24 with small cavities 32 on the bottom 34 of the flange 30 encompassing the flat areas 26 and with the bolts 28 extending upwardly through holes 36 in the flange 30. Nuts 38 or similar securing members (not shown) can be used in the obvious manner in connection with the bolts 28 in order to hold the cover 10 in place. This flange 30 extends around and outwardly from the base 40 of a centrally located grate 42 forming the central part of the cover 10. This grate 42 can be constructed in any common manner so as to in effectively serve as a screen or filter in keeping debris (not shown) from entering the transition section 18. As shown, the base 40 is normally of about the same diameter as the section 18. It preferably should be at least about 5 inches (12.7 cm) in diameter and at least the same height in order to have a large enough surface to accommodate the quantity of organic matter such as leaves which can be expected to come in contact with it.

In accordance with the invention, the perphery 44 of the flange 30 carries a primary rim 46 serving as weir. This rim 46 extends upwardly from the top 48 of the flange 30 at a right angle to this flange 30 and is located so as to be concentric around the base 40. The height of the rim 46 is preferably not greater than about one and a half inches (3.8 cm) so as not to excessively impede the flow of leaves and the like over it. A series of small, upwardly facing, Vee-shaped notches 50 are located in the upper edge 52 of the rim 46 so as to extend downwardly toward the flange 30. These notches 50 are equally spaced around the grate 42 and are all of the same dimension. They all have lower pointed ends 54 which are spaced a short distance from the top 48 of the flange 30.

A secondary rim 56 which also serves as a weir is located on the flange 30 immediately adjacent to and spaced from the base 40 of the grate 42. This rim 56 also extends upwardly from the the top 48 of the flange 30 at a right angle to this flange 30 and is also located so as to be concentric about the base 40. The height of this rim 56 need not be as great as the height of the rim 46. Preferably it is less than the height of the rim 46 and is at least 50 percent of the height of the rim 46. A series of notches 58 reasonably corresponding to the previously described notches 50 are located in the upper edge 60 of the rim 56. These notches 58 are all of the same shape as the notches 50 but are smaller than the notches 50; they are also equally spaced around the grate 42 and are all of the same dimension. Further these notches 58 all have lower pointed ends 62 spaced a short distance from the top 48 of the flange 30.

With this construction the rim 56 is spaced a short distance from the base 40 of the grate 42 so as to in effect define in connection with the top 48 of the flange 30 and the base 40 a small channel 64 which is concentric with the base 40. Small "weep" or drainage holes 66 lead from this channel 64 through the flange 30. A series of radially extending slots 68 leading completely through the flange 30 are provided between the rims 46 and 56. These slots 68 extend radially outwardly from the grate 42. Both the slots 68 and the holes 66 are spaced equally from one another completely around the grate 42.

Normally surface irregularities on the bottom 34 and the depression 32 will preclude the flange 30 fitting within the depression 32 so as to preclude water from moving under the flange 30 when the cover 10 is installed. However, to preclude any possibility of this happening the bottom 34 is preferably made somewhat non-flat in shape by the inclusion of minor, barely visible surface irregularities. These irregularities are not illustrated because of their small size.

When the drain cover 10 is installed as illustrated and described the rims 46 and 56 will serve as weirs so as to hold back gravel or other inorganic particles 70 on the roof 12 when significant amount of water (not shown) are flowing generally toward the roof drain 14. The particles 70 which are held back in this manner will more or less form a permeable ring or dam along the rim 46 which will permit some flow through the notches 50. Because of the limited size of the rim 46 normally organic matter (not shown) such as leaves will tend to be deflected above it and above any particles 70 resting more or less against it so that such organic matter does not conglomerate with the particles in forming a more or less water imprevious barricade. Instead water will always be able to flow through the notches 50. As a result there will be little tendency for a body of water to accumulate generally outside of the rim 46.

As water flows through the notches 50 some comparatively fine organic material or particles 70 will tend to be carried with it. Such comparatively fine particles 70 will tend to accumulate in the slots 58 so as to be held so as to tend to impede water flow. In this connection the slots 68 act more or less as grooves in a sluice box so as to hold back inorganic material. Such of the latter as is not held back by these slots will be held back by the rim 56. In this connection the rim 56 will act in the same manner as the rim 46 so as to cause particles 70 to accumulate in a permeable ring against the rim 56. Such water as permeates this accumulation of particles 70 will pass through the notches 58 and in due course will pass through the holes 66. Concurrently organic mater will tend to "float up" over and above the particles 70 so as be filtered out or the water passing toward and through the drain by the grate 42.

It will be apparent that the cover 10 used is desirable since it tends to separate different classes of materials in such a manner as to tend to preclude a combination of different types of materials from precluding or seriously inhibiting water flow to a through the drain 14. In effect the separation action involving different classes of materials is a type of a decantation action in which the inorganic particles 70 are held against movement and are segregated or filed by size by the two rims 46 and 56 employed whille concurrently the normally somewhat lighter organic materials present such as leaves, paper and like will tend to float up and over the heavier inorganic particles 70. As a consequence of this action there will be only a limited tendency for any significant amount of water such as might cause structural damage to accumulate on a roof adjacent to the drain 14, even when there is significant water flow. To a large extent this is a consequence of the fact that the primary rim 46 stops at least comparatively large particles well away from the grate 42 while slowing water to flow through the particles so held back. Then, with the invention this same action is repeated a second time by the rim 56.

I claim:

1. A roof drain cover having a centrally located, upstanding, perforate, hollow grate and a generally circular peripheral mounting flange attached to the periphery of the bottom of said grate so as to extend outwardly therefrom in which the improvement comprises:

said grate having a generally circular peripheral end meeting perpendicularly with said flange and joining integrally therewith;

a primary upstanding circular rim serving as a weir attached to the periphery of said mounting flange so as to extend upwardly from said flange a distance less than the height of said grate, said primary rim having a plurality of first notches located so as to extend from the upper end of said rim toward the flange, said first notches in said primary rim being equally spaced from one another and terminating above said flange, a secondary upstanding circular rim also serving as a weir formed as part of said mounting flange adjacent to and outside the juncture of said grate and said mounting flange so as to be spaced from said grate to define a channel between said grate and said secondary rim and so as to extend upwardly from said mounting flange a distance less than the height of said grate, said secondary rim having a plurality of second notches located so as to extend from the upper end of said rim toward the mounting flange, said second notches in said secondary rim being equally spaced from one another and terminating above said mounting flange, and particle collection means located in said mounting flange between said primary and secondary rims;

said second notches being of a size smaller than said first notches, the respective sizes of said first and second notches and respective heights of said primary and secondary rims being selected such that inorganic material is filtered by size and said primary and secondary rims and such that organic matter lighter than said inorganic matter floats up and over heavier inorganic material;

said peripheral mounting flange including weep holes leading through said mounting flange from said channel.

2. A roof drain cover as claimed in claim 1 wherein:

said particle collection means are a plurality of radially extending slots in said flange, said slots being spaced equidistant from another and extending through said flange.

3. A roof drain cover as claimed in claim 1 wherein:

said grate is at least 5 inches (12.7 cm) in diameter and height, said primary rim is not greater than about 1½ inches (3.8 cm) high, and said secondary rim is of less height than said primary rim and is at least 50% of the height of said primary rim.

4. The invention of claim 1 wherein said primary upstanding rim is formed as part of said mounting flange.

5. The invention of claim 4 wherein said roof drain cover is a unitary plastic structure.

* * * * *